United States Patent [19]

Graeser, Jr. et al.

[11] Patent Number: 4,565,418

[45] Date of Patent: Jan. 21, 1986

[54] INSULATION DISPLACEMENT TERMINAL FOR NONMETALLIC CORE CABLE

[75] Inventors: Joseph H. Graeser, Jr., Cortland; Rudolph A. Schlais, Jr., Warren, both of Ohio

[73] Assignee: General Motors Corporation, Detroit, Mich.

[21] Appl. No.: 689,441

[22] Filed: Jan. 7, 1985

[51] Int. Cl.[4] ..... H01R 4/24

[52] U.S. Cl. ..... 339/97 C

[58] Field of Search ..... 339/97 R, 97 C, 97 P, 339/98, 99 R, 276 R, 276 T

[56] References Cited

U.S. PATENT DOCUMENTS 2,873,434 2/1959 Drum et al. ..... 339/97 C

*Primary Examiner*—Joseph H. McGlynn

*Attorney, Agent, or Firm*—Francis J. Fodale

[57] ABSTRACT

An insulation displacement terminal for nonmetallic core cable comprises an insulation displacement portion having fore and aft crimp barrels connected by a bridge. The bridge has flat plates integrally connected at opposite sides by bights so that the plates confront each other. The plates have sharp edges for penetrating and slicing through the cable jacket and insulation and elongated dimples which cooperatively form the slot which receives the nonmetallic conductive core of the cable.

2 Claims, 6 Drawing Figures

INSULATION DISPLACEMENT TERMINAL FOR NONMETALLIC CORE CABLE

This invention relates generally to insulation displacement terminals and, more particularly, to insulation displacement terminals for ignition cable or the like in which the conductive core comprises strands of nonmetallic material such as high temperature nylons, polyamids, silicones and other high tensile strength materials which are coated impregnated or otherwise suitably treated to make them electrically conductive.

Insulation displacement terminals for either solid or stranded metallic core cable are already well known in the art. See for instance U.S. Pat. No. 4,062,615 granted to John N. Navarro on Dec. 13, 1977; U.S. Pat. No. 4,373,769 granted to Istvan Mathe and Alan H. Kasper on Feb. 15, 1983; and U.S. Pat. No. 4,385,794 granted to John E. Lucius on May 31, 1983.

However so far as we are aware, an insulation displacement terminal suitable for use with nonmetallic core cable does not exist and consequently, the object of our invention is to provide such an insulation displacement terminal.

Such a terminal is very attractive for terminating ignition cable which is generally now terminated by a strip and fold technique which involves cutting off and discarding about an inch of the EPDM or SBR synthetic rubber insulation and Hypalon, Cosil or silicone jacket of the cable, all of which are relatively expensive materials.

A significant feature of our invention is that the insulation displacement slot is formed by elongated dimples on flat confronting plates tso avoid injury to the nonmetallic strands of the conductive core which are seriously weakened by any nicks or the like.

Another feature of our invention is that crimp barrels are used fore and aft of the insulation displacement slot to securely attach the cable and the terminal together and thus effectively eliminate any strain which would produce significant movement of the cable core in the insulation displacement slot.

Still another feature of our invention is that the flat confronting plates which provide the dimples defining the insulation displacement slot have sharp edges which slice through the cable insulation and jacket without tearing the material of either.

Yet another feature of our invention is that the flat confronting plates are spaced so as to gather the conductive core into the slot formed by the dimples and the dimples are spaced apart less than the diameter of the conductor core so that it is distorted into an oval shape to enhance the contact between the core and the dimples.

Other objects and features of the invention will become apparent to those skilled in the art as the disclosure is made in the following detailed description of a preferred embodiment of the invention as illustrated in the accompanying sheet of drawing in which.

Figure 1:
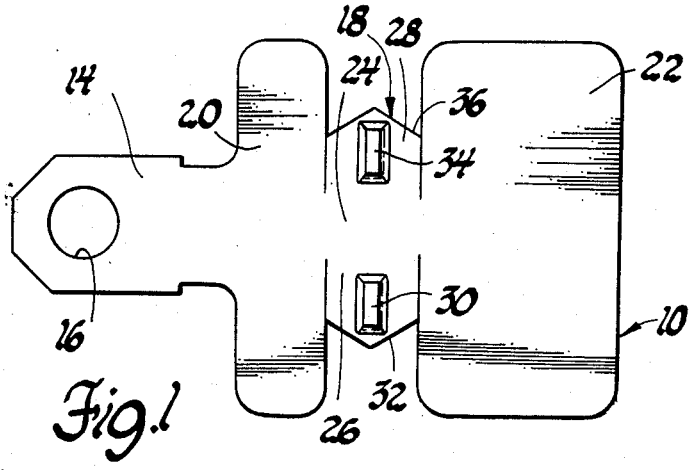
FIG. 1 is a plan view of a stamped sheet metal blank for constructing an insulation displacement terminal in accordance with our invention.

Referring now to the drawing, our invention is illustrated in conjunction with an insulation displacement terminal 10 for connecting an ignition cable 12 or the like which is characterized by a nonmetallic conductor core, to another electric component such as a spark plug or a distributor. The contact portion 14 of the terminal is shown as a flat blade having an aperature 16 for connection to a post terminal by a thumb screw (not shown). It should be understood, however, that our invention can be utilized with any type of the contact portion such as a socket, a blade, a pin, a ring or any other suitable structure for making an electrical contact with another electrical device or a mating terminal.

Our invention is concerned with the insulation displacement portion of the terminal 10 indicated generally at 18. In this regard, the terminal 10 comprises a forward open crimp barrel 20 and a rearward open crimp barrel 22 spaced apart and connected by an intermediate bridge 24. The bridge 24 has a pair of flat plates 26 and 28 integrally connected to the opposite sides of the bridge 24. The flat plates 26, 28 are bent up with respect to the bridge 24 forming respective bights so that the flat plates 26, 28 are spaced apart and confront each other.

The flat plate 26 has an elongated dimple 30 which is transverse to the common axis or centerline of the crimp barrels 20, 22 and which extends toward the flat plate 28. The flat plate 26 has a sharp convex edge 32 at the side of the plate opposite the bridge 24. The convex edge 32 has a peak located above the elongated dimple 30.

Figure 3:
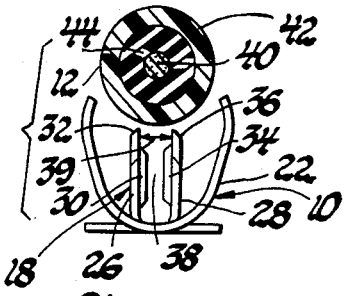
FIG. 3 is an end view of the insulation displacement terminal taken substantially along the line 3—3 of FIG. 2 looking in the direction of the arrows.
Figure 2:
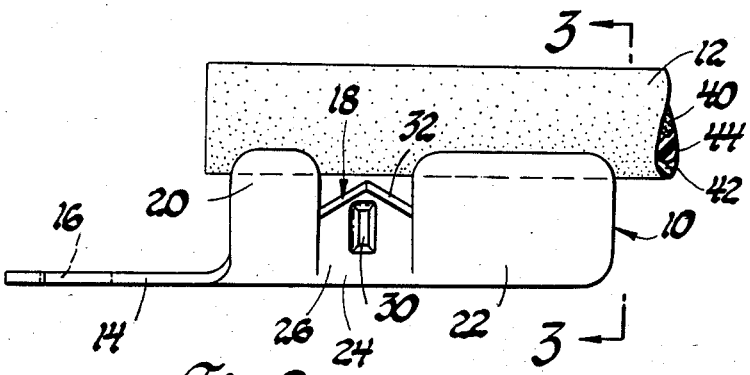
FIG. 2 is a side view of an insulation displacement terminal made from the stamped sheet metal blank shown in FIG. 1 positioned for assembly onto the end of a nonmetallic core cable.
Figure 4:
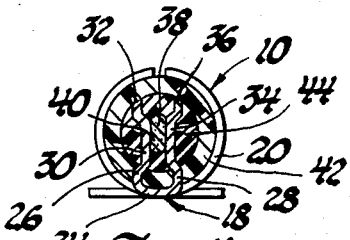
FIG. 4 is a transverse section view taken substantially along the line 4—4 of FIG. 6 looking in the direction of the arrows and showing the terminal attached to the end of the cable.
Figure 5:
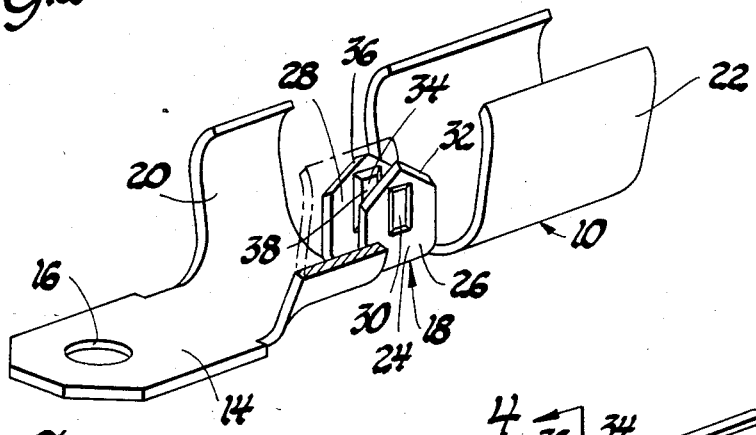
FIG. 5 is a partially sectioned perspective view of the insulation displacement terminal.
Figure 6:
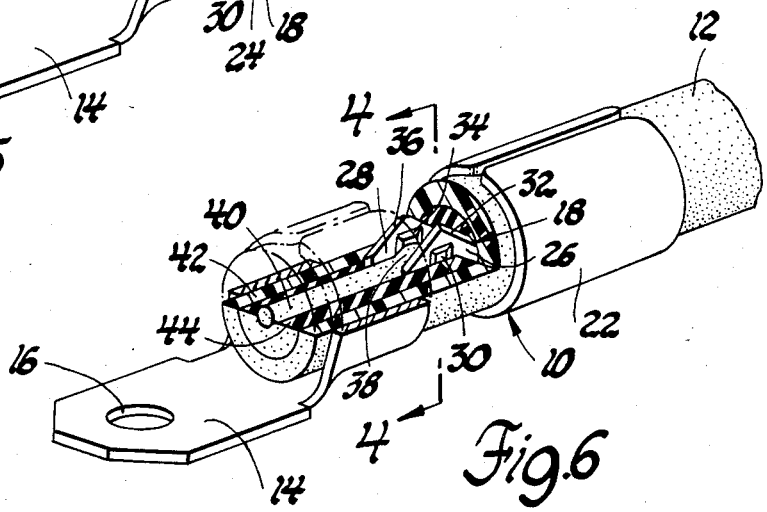
FIG. 6 is a partially sectioned perspective view of the insulation displacement terminal attached to the end of the cable.

The flat plate 28 also has an elongated transversely oriented dimple 34 which extends toward the flat plate 26 and a sharp convex edge 36 at the side of the plate opposite the bridge 24. The dimples 30, 34 confront each other and form a slot 38 for receiving the nonmetallic conductive core 40 of the cable 12 as best shown in FIGS. 3, 4 and 6.

As the ignition cable 12 is forced down into the open crimp bazrrels 20, 22, the sharp edges 32, 36 penetrate and then slice through the jacket 42 and synthetic rubber insulation layer 44 of the ignition cable 12 without tearing the material of either. The spacing 39 between the flat plates 26, 28 is greater than the diameter of the core 40 so that the flat plates 26, 28 gather in the core 40 and direct it into the narrower slot 38 which is defined by the dimples 30, 34 to establish electrical contact. The width of the slot 38 is less than the diameter of the core 40 so that the core 40 is distorted to an oval shape to enhance the physical contact between the core 40 and the dimples 30, 34 as best shown in FIGS. 4 and 6.

The open crimp barrels 20, 22 are then crimped about the jacket 42 of the ignition cable 14 fore and aft of the established electrical connection in conventional manner. This securely fastens the cable 12 and the terminal 10 together so as to effectively eliminate any strain which would produce significant movement of the conductive core 40 in the slot 38.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An insulation displacement terminal for piercing the insulation of an insulated electrical cable and making contact with a nonmetallic conductive core of the cable comprising, an insulation displacement portion having first and second crimp barrels spaced apart longitudinally and connected by an intermediate bridge, first and second plates connected at opposite longitudinal sides of the bridge by respective bights so that the first and second plates are spaced apart and confront each other, and a transversely elongated dimple in each plate which extends toward the dimple of the other plate to cooperatively form a core receiving slot, and each of said plates having a sharp edge at the side opposite the bridge for penetrating and slicing through the insulation of an insulated cable forced down between the plates so that the nonmetallic conductive core enters the slot cooperatively formed by the elongated dimples.

2. An insulation displacement terminal for piercing the insulation of an insulated electrical cable and making contact with a nonmetallic conductive core of the cable comprising, an insulation displacement portion having first and second crimp barrels spaced apart longitudinally and connected by an intermediate bridge, first and second flat plates connected at opposite longitudinal sides of the bridge by respective bights so that the first and second flat plates are spaced apart in a confronting relationship by a distance which is less than the outer diameter of the cable and greater than the diameter of the nonmetallic conductive core, a transversely elongated dimple in each plate which extends toward the dimple of the other plate to cooperatively form a core receiving slot which has a width which is less than the diameter of the nonmetallic conductive core so that the core distorts to an oval shape when it is disposed in the slot, and each of said plates having a sharp convex edge at the side opposite the bridge for penetrating and slicing through the insulation of an insulated cable forced down between the flat plates so that the nonmetallic conductive core enters the slot cooperatively formed by the elongated dimples.

* * * * *